United States Patent [19]

Soemers

[11] Patent Number: 4,803,559

[45] Date of Patent: Feb. 7, 1989

[54] METHOD OF MOUNTING A DEFLECTION UNIT ON A CATHODE RAY TUBE ENVELOPE AND COMBINATION RESULTING THEREFROM

[75] Inventor: Hermanus M. J. R. Soemers, Eindhoven, Netherlands

[73] Assignee: U.S. Philips Corporation, New York, N.Y.

[21] Appl. No.: 125,857

[22] Filed: Nov. 27, 1987

[30] Foreign Application Priority Data

Dec. 3, 1986 [GB] United Kingdom ..... 8628906

[51] Int. Cl.[4] ..... H01J 9/236; H01J 9/42

[52] U.S. Cl. ..... 358/248; 445/3; 219/121.64; 219/121.82; 219/121.63

[58] Field of Search ..... 358/248; 445/3, 63; 219/121.82, 121.64, 121.63

[56] References Cited

U.S. PATENT DOCUMENTS

| | | | |
|---|---|---|---|
| 3,643,299 | 2/1972 | Brown | 219/121.82 X |
| 3,939,447 | 2/1976 | D'Amato | 358/248 |
| 4,163,308 | 8/1979 | Tawa et al. | 445/3 X |
| 4,323,817 | 4/1982 | Vennix | 358/248 X |

*Primary Examiner*—Kenneth J. Ramsey

*Attorney, Agent, or Firm*—John C. Fox

[57] ABSTRACT

The invention describes a method of accurately mounting a deflection unit on a cathode ray tube envelope. The deflection unit is provided with three V-shaped connecting devices and globally positioned with respect to metal mounting pads thermal compression bonded to the envelope. Three adjustable manipulators, each provided with a socket for engaging a semi-spherical part on one of the V apexes, accurately position the deflection unit on the envelope to obtain an accurate test pattern on the cathode ray tube screen. Finally the V-shaped devices are laser-welded to the mounting pads by laser devices incorporated with said manipulators.

2 Claims, 4 Drawing Sheets

METHOD OF MOUNTING A DEFLECTION UNIT ON A CATHODE RAY TUBE ENVELOPE AND COMBINATION RESULTING THEREFROM

BACKGROUND OF THE INVENTION

The present invention relates to a method of mounting a deflection unit on a cathode ray tube envelope.

The invention also relates to a combination of a cathode ray tube and a deflection unit made by said method.

Proposals for mounting deflection units are disclosed in U.S. Pat. Nos. 3,986,156 and 3,939,447. In the case of U.S. Pat. No. 3,986,156 an annular platform is bonded onto the external surface of the tube cone. A housing is mounted on the deflection unit. At positions disposed at 90° of rotation about the Z-axis of the display tube, rigid members are disposed between and connect the deflection yoke to the platform. A test-pattern is displayed on the display tube and the position of the deflection unit is adjusted so that a correct test pattern is displayed and subsequently the rigid members are either bonded or ultrasonically welded in position. Such a mounting arrangement has three strong degrees of freedom and three weak degrees of freedom.

U.S. Pat. No. 3,939,447 discloses three embodiments of a yoke mounting means. In the simplest of these three embodiments the deflection unit is mounted in an annular housing with four cantilever springs extending therefrom. This assembly is placed on the neck of the display tube so that the free ends of the springs are in direct contact with the conical portion of the tube envelope. Each spring has a hollow post thereon which serves as a conduit for adhesive. After the deflection unit has been adjusted then the springs are bonded to the conical portion by adhesive introduced through the hollow posts. Optionally auxiliary coil springs may be attached between the posts and the display tube mounting means to minimize any shearing force between the cantilevered springs and the conical portion of the envelope caused by the pressure of the cantilevered springs which, due to the adjustment of the deflection unit, are under varying degrees of distortion. The use of adhesives to secure the springs to the envelope has a number of disadvantages with respect to the speed of fixing and the reliability of the respective joints.

These methods of deflection unit mounting do not lend themselves to being easily mechanized. For mechanisation of the deflection unit mounting it is necessary to be able to mount the deflection unit on the tube neck, adjust the unit to its optimum position to give a proper image and to fix the unit in this optimum position very rapidly. The mounting arrangement should be such as to provide shock resistance, thermal stability over the expected working life of the tube and only 6 degrees of freedom.

SUMMARY OF THE INVENTION

According to the present invention there is provided a method of mounting a deflection-unit on a cathode ray tube envelope, comprising thermally compression bonding metal mounting pads at predetermined positions on the envelope; providing at least six connecting members to the deflection unit, pairs of the connecting members having corresponding ends connected at spaced apart positions to the deflection unit, each connection point being contiguous with a connection point of an end of an adjacent member of another pair, the members of each pair being mutually convergent so that their terminal points are contiguous, providing each terminal point with a semi-spherical part having a hole therein through which a portion of the terminal portion is visible; disposing a deflection unit on the envelope; resiliently urging manipulators each comprising a socket against respective semi-spherical parts in such a manner that the socket frictionally engages the respective semi-spherical part and that the contiguous terminal portions of the pairs of connecting members are contacting substantially tangentially their respective mounting pad; displaying a test pattern on the cathode ray tube; and actuating the manipulators to adjust the deflection unit until an optimum pattern is obtained and with the manipulators in engagement with the semi-spherical parts laser-welding the terminal portion to their respective mounting pad via a laser-beam produced within each manipulator and passing through the hole in its associated semi-spherical part. This method of mounting a deflection unit on a cathode ray tube envelope lends itself to be easily mechanised and also allows the adjustment of the deflection unit in six degrees of freedom so that the position of the deflection unit can be fixed accurately whilst being held in its optimum position by the manipulators. Furthermore one obtains a shock resistant mounting of the deflection unit, typically the connections can resist up to 50 G, where G is the acceleration due to gravity.

BRIEF DESCRIPTION OF THE DRAWINGS

The present invention will now be described, by way of example, with reference to the accompanying drawings, wherein.

DESCRIPTION OF THE PREFERRED EMBODIMENTS

The method of mounting a deflection unit on a cathode ray tube envelope according to the invention comprises several successive steps that will be described with reference to the Figures.

Figure 1:
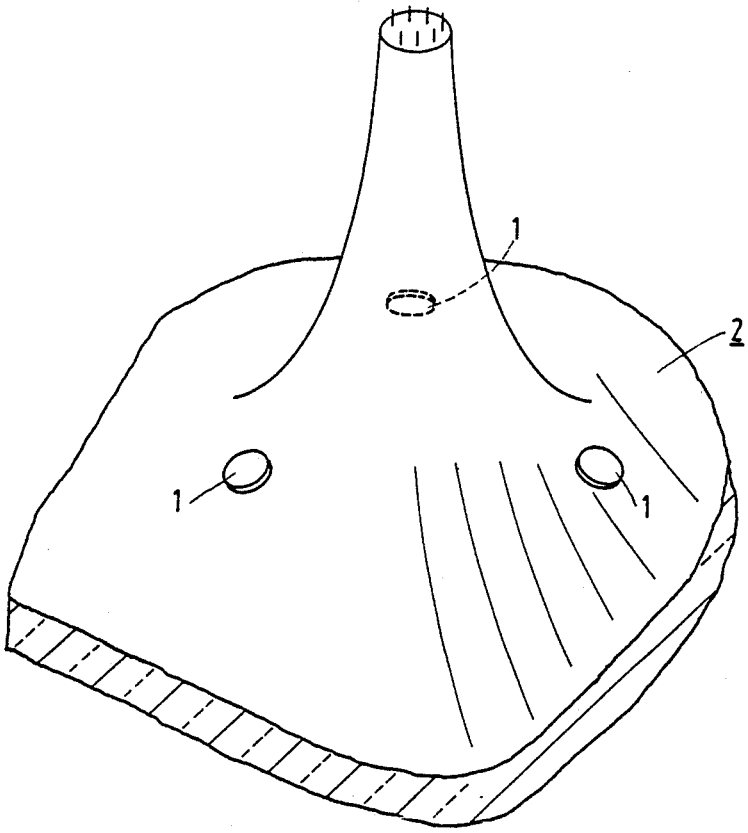
FIG. 1 is a perspective view of a part of a cathode ray tube envelope provided with metal mounting pads.
Figure 2:
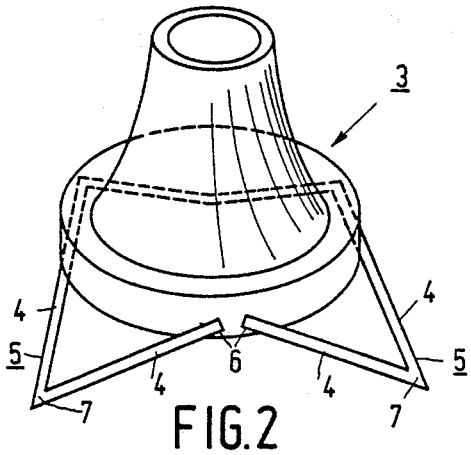
FIG. 2 is a perspective view of a deflection unit provided with six connecting members.
Figure 3:
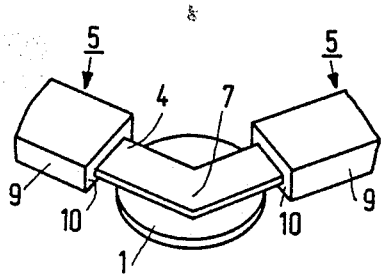
FIG. 3 is a perspective view showing the contiguous terminal point of two adjacent connecting members.
Figure 5:
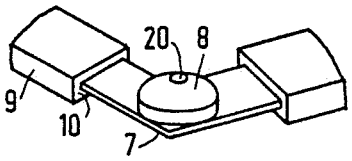
FIG. 5 is a diagrammatic view showing a terminal point provided with a semi-spherical part.

Before the deflection unit is mounted on the envelope of a cathode ray tube metal mounting pads 1 are thermally compression bonded at predetermined positions on the envelope 2 as is shown in FIG. 1. The mounting pads 1 are fabricated from a material which has substantially the same coefficient of expansion as the glass of the envelope 2 to which they are thermally compression bonded. A suitable material is an alloy of indium, cobalt and nickel. The deflection unit also has to be prepared for mounting as is shown in FIG. 2 which illustrates a deflection unit 3 comprising three pairs of connecting members 4. Corresponding terminal portions of the members 4 are joined to a V-shaped portion 7 and a connecting device 5 is formed as is shown more clearly in FIG. 3. The free ends 6 of the devices 5 are attached at spaced apart positions to the deflection unit 3. To make the connecting members 4 resistant to buckling they are enveloped by a layer 9 of synthetic material as is shown in FIG. 3. It is also possible to adapt the cross-sectional shape of the connecting members 4 in such a way as to make them resistant to buckling. As a last step before the deflection unit 3 can be mounted on the envelope 2 a semi-spherical part 8 is provided on each V-shaped portion 7 as is shown in FIG. 5, which semi-spherical part 8 has a hole 20 therethrough.

Figure 4:
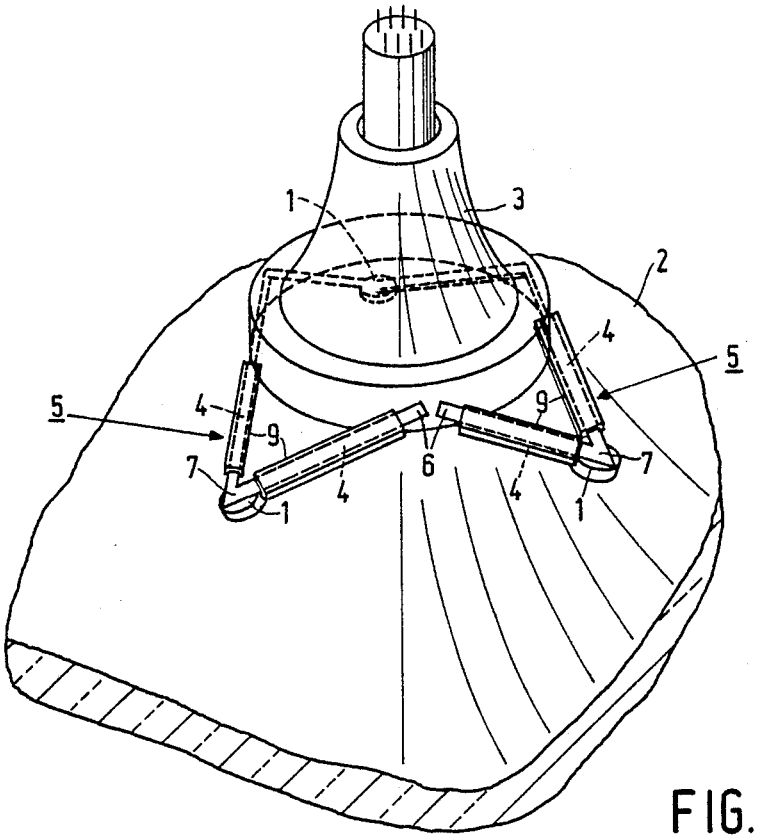
FIG. 4 is a perspective view of a part of a cathode ray tube illustrating the deflection unit mounting system.
Figure 7:
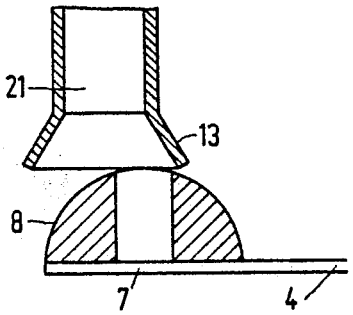
FIG. 7 is a diagrammatic cross-sectional view of a socket of a manipulator approaching a terminal point, FIGS. 8*a, b* and *c* are diagrammatic partial cross-sectional views showing schematically the steps of positioning a deflection unit.
Figure 6:
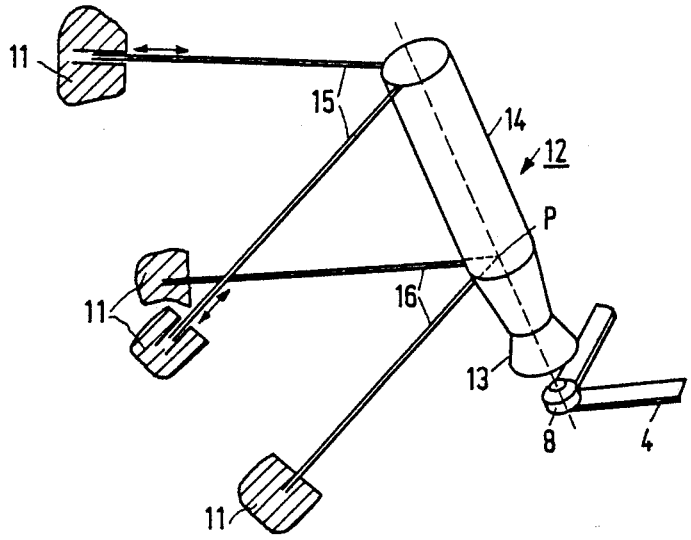
FIG. 6 is a perspective view of a manipulator.
Figure 8A:
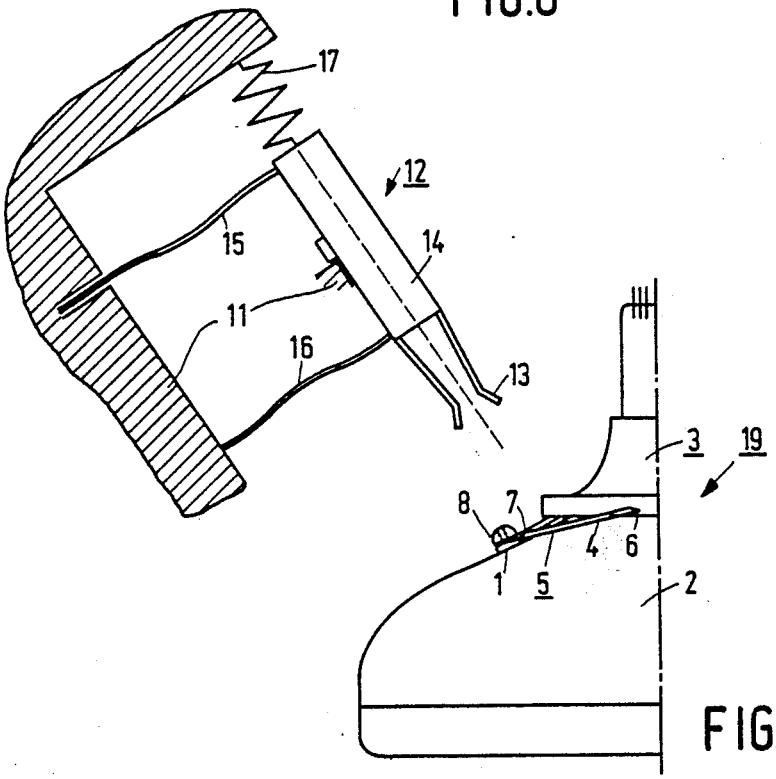
Figure 8B:
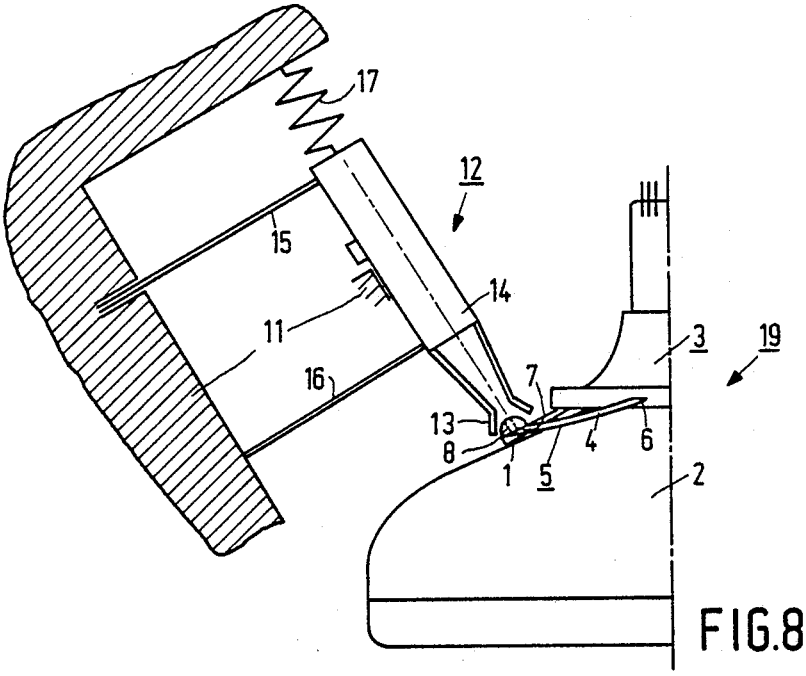
Figure 8C:
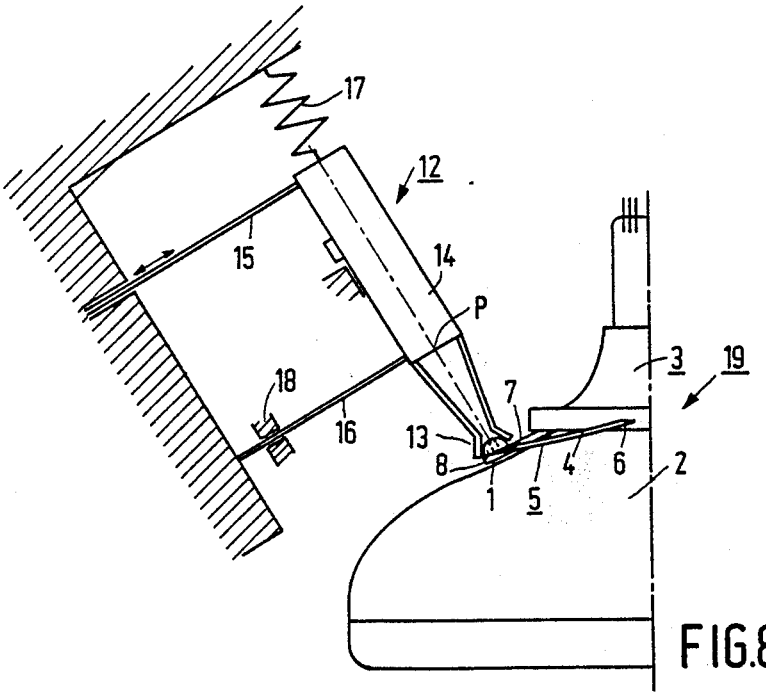

After these preparations the deflection unit 3 is disposed on the envelope 2 of a cathode ray tube such that the V-shaped portions 7 overlap the mounting pads 1 as is shown in FIG. 4. An additional advantage of the layer 9 of synthetic material provided around the connecting members 4 is that they can provide a global positioning of the deflection unit 3 on the envelope 2. This global positioning is realised in that the edge 10 of the layer 9 acts as a course guide for the connecting device 5 as is shown in FIG. 3. The accurate positioning of the deflection unit 3 is obtained by disposing the cathode ray tube with the deflection unit 3 globally on the envelope 2 in a positioning machine 11 (FIG. 6) comprising several manipulators 12, one of which is shown in perspective in FIG. 6 and diagrammatically in cross-section in FIG. 8*a*. Each manipulator 12 is flexibly mounted on the positioning machine 11 by means of movable members 15, members 16 rigidly connected to the positioning machine 11, and a spring member 17. Each manipulator 12 comprises a cup-like socket 13 having a cross-sectional shape to easily engage the semi-spherical part 8 provided on the V-shaped portion 7 of each connecting device as is shown diagrammatically in FIG. 7. The socket 13 has a hole 21 therethrough to permit emergence of laser-light, produced by laser-optics 14 within the manipulator 12. After the combination of the deflection unit 3 and the envelope 2 is disposed in the positioning machine 11, the combination and the positioning machine are moved relatively to each other until the socket 13 of the manipulator 12 rigidly engages the semi-spherical part 8 of the respective connecting device. Continued relative moves cause the spring 17 to press the manipulator 12 against the semi-spherical part 8 so that the terminal portion 7 contacts the mounting pad 1 as is shown in FIG. 8*b*. Subsequently a test pattern is displayed on the cathode ray tube 19 and the member 16 is clasped by a clasping-device 18. Adjusting the members 15, as is schematically indicated by arrows in FIG. 6 and FIG. 8*c*, causes the manipulator 12 to rotate about the point P. During this adjustment the spring 17 presses the terminal portion 7 against the respective mounting pad 1, such that the terminal portion 7 is adjusted substantially tangentially with respect to the mounting pad 1. The dimensions of the layer 9 are such that it does not impede this accurate adjustment. When the deflection unit has been adjusted so that an optimum pattern is obtained the members 15 are fixed in their position. With the manipulators still in their fixed positions the terminal portion 7 is laser-welded to the respective mounting pad 1 by means of a laser-light passing through the hole in the semi-spherical part. Finally the cathode ray tube with the deflection unit accurately mounted on the envelope is taken out of the positioning machine and is ready for further use.

It will be clear that the method of mounting a deflection unit on a cathode ray tube envelope in accordance with the invention as described above uses three manipulators to enable the deflection unit to be accurately mounted in six degrees of freedom. The described method can easily be mechanized and provides a very accurate method of mounting a deflection unit on a cathode ray tube envelope.

What is claimed is:

1. A method of mounting a deflection-unit on a cathode ray tube envelope, comprising thermally compression bonding metal mounting pads at predetermined positions on the envelope; providing at least six connecting members to the deflection unit, pairs of the connecting members having corresponding ends connected at spaced apart positions to the deflection unit, each connection point being contiguous with a connection point of an end of an adjacent member of another pair, the members of each pair being mutually convergent so that their terminal points are contiguous, providing each terminal point with a semi-spherical part having a hole therein through which a portion of the terminal point is visible; disposing a deflection unit on the envelope; resiliently urging manipulators each comprising a socket against respective semi-spherical parts in such a manner that the socket frictionally engages the respective semi-spherical part and that the contiguous terminal portions of the pairs of connecting members are contacting substantially tangentially their respective mounting pad; displaying a test pattern on the cathode ray tube; and actuating the manipulators to adjust the deflection unit until an optimum test pattern is obtained and with the manipulators in engagement with the semi-spherical parts laser-welding the terminal portion to their respective mounting pad via a laser-beam produced within each manipulator and passing through the hole in its associated semi-spherical part.

2. The combination of a cathode ray tube and a deflection unit made by the method as claimed in claim 1.

* * * * *